US006826121B1

(12) United States Patent
Olexa

(10) Patent No.: US 6,826,121 B1
(45) Date of Patent: Nov. 30, 2004

(54) HUMAN FACTOR TIME TRANSLATION OF BUSINESS INFORMATION TO CONSUMERS OVER THE INTERNET

(76) Inventor: Christopher M. Olexa, 4019 Rosemeade Dr., Fairfax, VA (US) 22033

( * ) Notice: Subject to any disclaimer, the term of this patent is extended or adjusted under 35 U.S.C. 154(b) by 0 days.

(21) Appl. No.: 10/662,342

(22) Filed: Sep. 16, 2003

Related U.S. Application Data

(63) Continuation of application No. 10/440,132, filed on May 19, 2003, now abandoned.
(60) Provisional application No. 60/380,833, filed on May 17, 2002.

(51) Int. Cl.[7] ..... G04B 47/00; G04B 19/24; G04C 19/00

(52) U.S. Cl. ..... 368/10; 368/29; 368/82; 702/178

(58) Field of Search ..... 368/10, 28, 29, 368/82; 702/176–178

(56) References Cited

U.S. PATENT DOCUMENTS 2,913,172 A 11/1959 Stedelin, Jr. et al.
3,518,633 A 6/1970 Croy
3,603,960 A 9/1971 Sanchez
3,644,712 A 2/1972 Goodrich, Jr.
3,760,160 A 9/1973 Gieringer et al.
4,812,627 A 3/1989 Wexler et al.
4,819,162 A 4/1989 Webb, Jr. et al.
5,111,391 A 5/1992 Fields et al.
5,717,867 A 2/1998 Wynn et al.
6,714,486 B2 * 3/2004 Biggs ..... 368/82
2001/0051888 A1 12/2001 Mayhak, Jr. et al.
2002/0010532 A1 1/2002 Sinex

* cited by examiner

*Primary Examiner*—Vit W. Miska
(74) *Attorney, Agent, or Firm*—Mark A. Wurm

(57) ABSTRACT

The present invention is a system and methods for providing time translation to a requester of information incorporating human factors. The requester initiates a request for information onto a computer network, typically the Internet. Time information contained in the request for information is extracted. A translation of the time according to human factors is compared to the time in a table of database records. A determination is made as to whether to include search results as meeting the requested time criteria. If the request is met, the results are displayed when all other required criteria are true.

15 Claims, 10 Drawing Sheets

30

FIG. 3

Listing

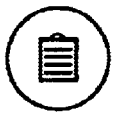

Listing

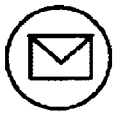

A new way for Customers to remember and refer your business...

- An orderly arrangement of your business information
- Contacting you becomes easy for your customers
- Easy to reference listing, fosters repeat business
- Practical information prevents customer frustration
- Saves you time and aids productivity

32

NetRoster.com Listing

Pomodoro Pasta Pizza and More
www.PomodoroPastaPizza.com

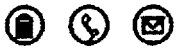

| | |
|---|---|
| Company name: | Pomodoro Pasta Pizza and More |
| Trade name: | Pomodoro Pasta Pizza and more |
| Business Description: | Italian "fast food" restaurant |
| NAICS Code: | 722110 |
| Contact Name: | Anthony Abrosino, Biagio Abrosino, Benny Scotto |
| Address: | 12152 Fairfax Towne Center |
| Business Park/ Shopping Center: | Fairfax Town Center |
| City: | Fairfax |
| County: | Fairfax |
| State: | VA |
| Zip Code: | 22033 |
| Primary Phone: | 703-273-7405 |
| Secondary Phone: | |
| Fax: | 703-273-7406 |
| Email: | |
| Web Site: | www.PomodoroPastaPizza.com |
| Payment Options: | American Express, Cash, Check, Diners Master Card, Visa, |
| Other Payment Options: | |
| Certifications and Licenses: | Alcoholic Beverage Control (ABC) License |
| Year Established: | 1999 |
| Name Brands used/ Sold: | Biondi, Lavazza, Coca Cola, Peroni |
| Keywords: | pasta, pizza, pomodoro, restaurant, Italian, food, fast food, beer, wine, desserts, coffee, hungry, hunger, eat, dine, guest |

Hours of Operation:

| | Open | Close |
|---|---|---|
| Mon. | 11:00 AM | 10:00 PM |
| Tue. | 11:00 AM | 10:00 PM |
| Wed. | 11:00 AM | 10:00 PM |
| Thu. | 11:00 AM | 10:00 PM |
| Fri. | 11:00 AM | 10:00 PM |
| Sat. | 11:00 AM | 10:00 PM |
| Sun. | 11:00 AM | 10:00 PM |

netposte netposte ster.com ster.com

FIG. 6

60

Business Hours: A Allstate Bonding Corporation, Inc.

<Back

* re-Open and re-Close is for businesses that close mid-day and reopen later that day.
Times should be entered on a 24 hrtime scale. (For instance: 8:00 PM = 20:00)

| | Open[1] | Close[1] | re-Open*[1] | re-Close*[1] | re-Open*[2] | re-Close*[2] |
|---|---|---|---|---|---|---|
| Monday: | 0:00 | 23:59 | | | | |
| Tuesday: | 0:00 | 23:59 | | | | |
| Wednesday: | 0:00 | 23:59 | | | | |
| Thursday: | 0:00 | 23:59 | | | | |
| Friday: | 0:00 | 23:59 | | | | |
| Saturday: | 0:00 | 23:59 | | | | |
| Sunday: | 0:00 | 23:59 | | | | |

Message: Always Open! <br>
Please let us know that you found us
through Netroster.com.

Update Business Hours

FIG. 7

70

| | |
|---|---|
| Company Name: | Anthony's Restaurant Inc |
| Trade Name: | Anthony's Restaurant and Sports Bar |
| Business Description: | Restaurant and Sports Bar |
| NAICS Code: | 722110 |
| Contact Name: | Anthony Yiannarakis |
| Address: | 7234 Centreville Road |
| Business Park/Shopping Center: | Plaza 28 |
| City: | Manassas |
| County: | Prince William |
| State: | VA |
| Zip Code: | 20111 |
| Primary Phone: | 703-361-1230 |
| Secondary Phone: | 800-551-2665 |
| Fax: | 703-361-1257 |
| Email: | |
| Web Site: | www.Anthony'sRestaurant.Netroster.com |
| Payment Options: | American Express, Cash, Diners, Discover, Master Card, Visa, |
| Other Payment Options: | |
| Certifications and Licenses: | |
| Year Established: | 1972 |
| Name Brands used/Sold: | |
| Keywords: | sports bar, Greek, Italian, restaurant, Northern Virginia, food, eat, fun, parties, weddings, receptions, rehersal, dinner, lunch |

Special Notes:
Close times are bar times. Restaurant closes 10PM SUN-Thur and 11PM Fri-Sat

72

Hours of Operation:

| | Open | Close |
|---|---|---|
| Mon. | 11:00 AM | 11:59 PM |
| Tue. | 11:00 AM | 11:59 PM |
| Wed. | 11:00 AM | 11:59 PM |
| Thu. | 11:00 AM | 11:59 PM |
| Fri. | 11:00 AM | 11:59 PM |
| Sat. | 11:00 AM | 11:59 PM |
| Sun. | 11:00 AM | 11:59 PM |

74

| | re-Open | re-Close |
|---|---|---|
| Mon. | 12:00 AM | 1:00 PM |
| Tue. | 12:00 AM | 1:00 PM |
| Wed. | 12:00 AM | 1:00 PM |
| Thu. | 12:00 AM | 1:00 PM |
| Fri. | 12:00 AM | 1:00 PM |
| Sat. | 12:00 AM | 1:00 PM |
| Sun. | 12:00 AM | 12:00 PM |

HUMAN FACTOR TIME TRANSLATION OF BUSINESS INFORMATION TO CONSUMERS OVER THE INTERNET

This application is a continuation of U.S. Utility patent application Ser. No. 10/440,132, entitled "Human Factor Time Translation Of Business Information To Consumers Over The Internet", filed May 19, 2003, now abandoned, the entire disclosure of which is incorporated herein by reference. That application claims the benefit of U.S. Provisional Application No. 60/380,833, entitled "Systems and Method for Providing Business Information to the Consumer Over the Internet", filed May 17, 2002 by Christopher M. Olexa, the teachings of which are incorporated herein by reference in their entirety.

FIELD OF THE INVENTION

The invention relates to a new system and methods for providing business information to consumers, and more particularly the invention incorporates a human factor time translation for delivering business hours of operation information to users.

BACKGROUND

Humans have difficulty perceiving time when crossing over periods which incorporate a new day. In perspective of human interaction, operational days and real time depictions of time do not coincide. For example, two hours past midnight on Friday is equivalent to Saturday 2:00 AM. Friday is the operational day and the day that humans perceive as being the same day because they have not made the mental change over to the next day.

Humans categorize the time of day and day changes based on individual perceptions and situations and habits. Perception of time may be measured statistically over various types of people based on profession, place of living, age, background, etc. People who stay up late to do Internet searches at 2:00 AM will perceive time differently then people who typically work 9:00 AM to 5:00 PM job.

There is a function applicable to the translation of time based on a type, history, age and habits of a person. A translational step is required to process time from calculated times to times displayed for human interpretation.

SUMMARY OF THE INVENTION

The invention provides a new search method and structured content which provides a translated time to users to account for human factors. The invention is specifically designed to fulfill the wishes of consumers for a practical local search tool for business and organization listings containing hours of operation. Consumers can find businesses, including hours of operations translated to match their perception of time of day. The system and methods provide time translation to a requester of information incorporating human factors. The requester initiates a request for information onto a computer network typically, the Internet. Time information contained in the request for information is extracted. A translation of the time according to human factors is compared to the time in a table of database records. A determination is made as to whether to include search results as meeting requested time criteria. If the request is met, the results are displayed when all other required criteria are true. Time translation methods may also incorporated in stand-alone systems for translation for computer applications outside of the search function explained.

BRIEF DESCRIPTION OF THE DRAWINGS

Illustrations are included in this application and are described in the attached specification and appended as detailed Figures.

FIG. 3 is a screenshot of a business Listing.

FIG. 6 is a screenshot of a business hours table for a NetListing.

FIG. 7 is a screenshot of a NetListing search showing business hours of operation.

DETAILED DESCRIPTION

The present invention is described using as an example a searchable directory of business Internet brochures known as NetListings. By melding the power of a search engine and the structure of a directory, the human factor time translation allows consumers to search for local businesses using their perception of time of day. The invention can be used in many different ways and still fall under the scope and spirit of the claimed invention.

Figure 1:
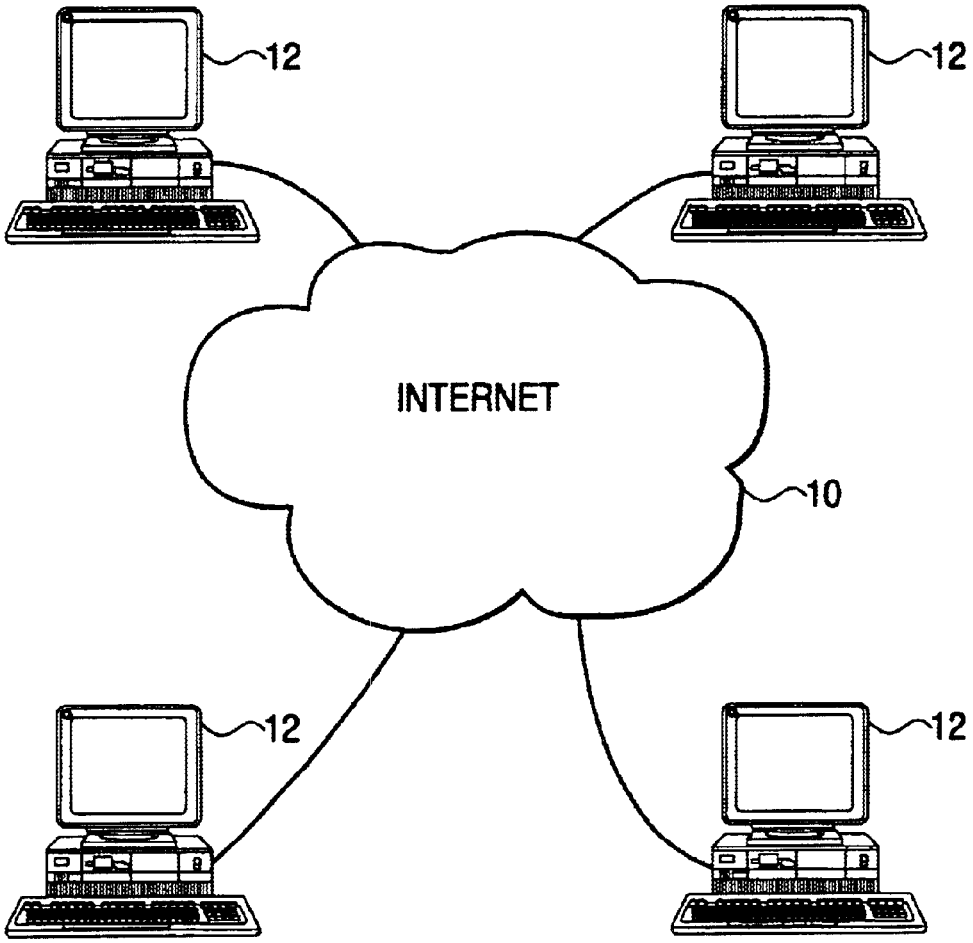
FIG. 1 is a diagram illustrating a computer network connected via the Internet.

Shown in FIG. 1 is a network of computers 12 interconnect via the Internet 10 to allow for content searching. In performing a search, the search criteria can include the business name, the business address, the business park/shopping center, zip code, brands used/sold, certifications and licenses, payment options, county, state, within the boundaries of a municipality, areas served, area code, business service type and even hours of operation. The described search example contains a three-part Internet brochure consisting of an infosheet, a listing, and an e-message. The infosheet is custom designed to describe the business. The listing is a simple to use directory with expanded practical information for the consumer. The e-message enables the consumer to easily access their computer or PDA to send a message to an email address, fax machine, or translated to voicemail. Coupons and other optional features may be included along with the Internet brochure.

The Internet brochure contains three parts, an infosheet, a listing and an e-message. These three parts have been designed to be text with optimized graphics. This efficiency of design allows for ease of scalability and limited hardware with high speed access.

Figure 2:
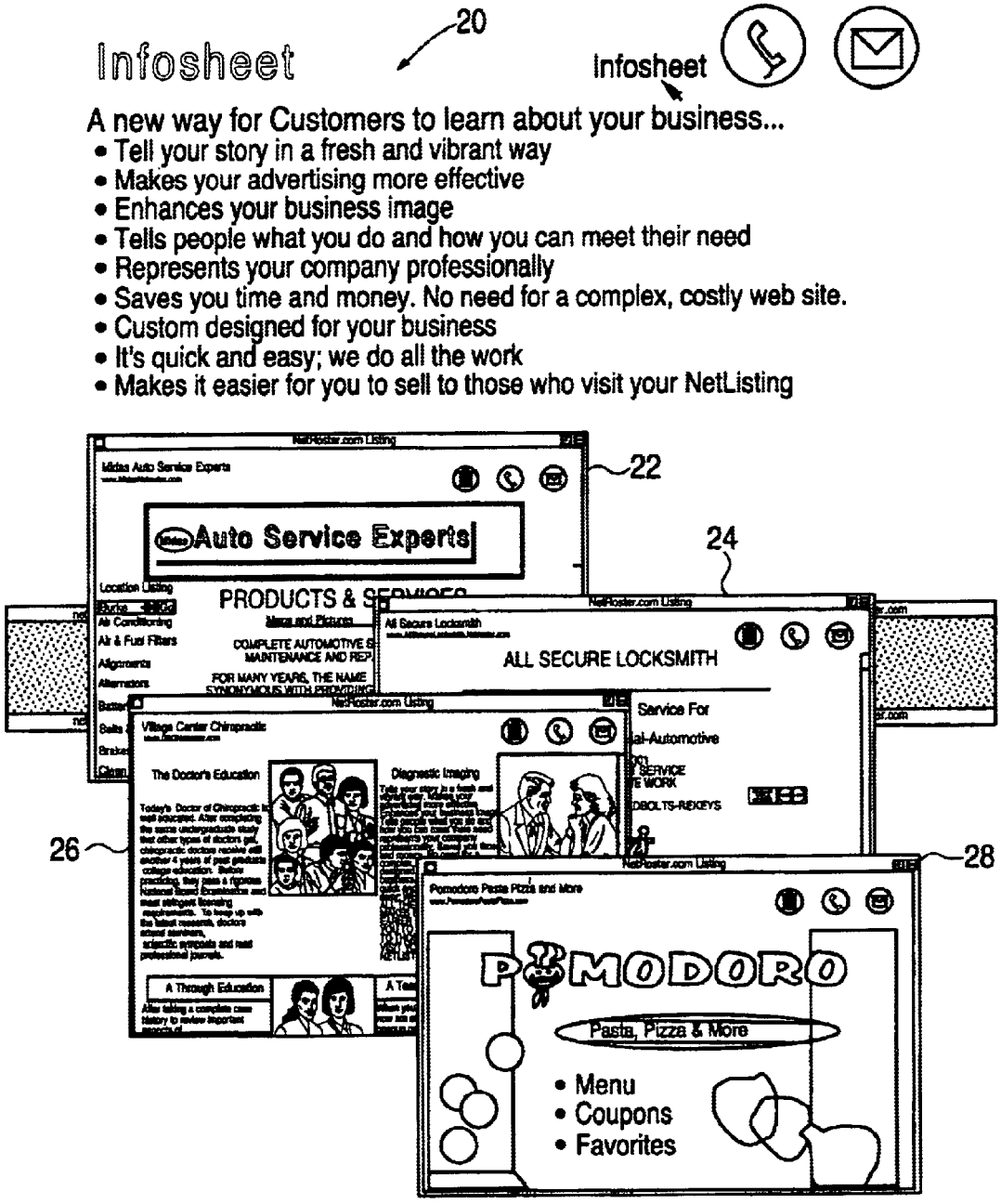
FIG. 2 is a screenshot of an Infosheet.
Figure 4:
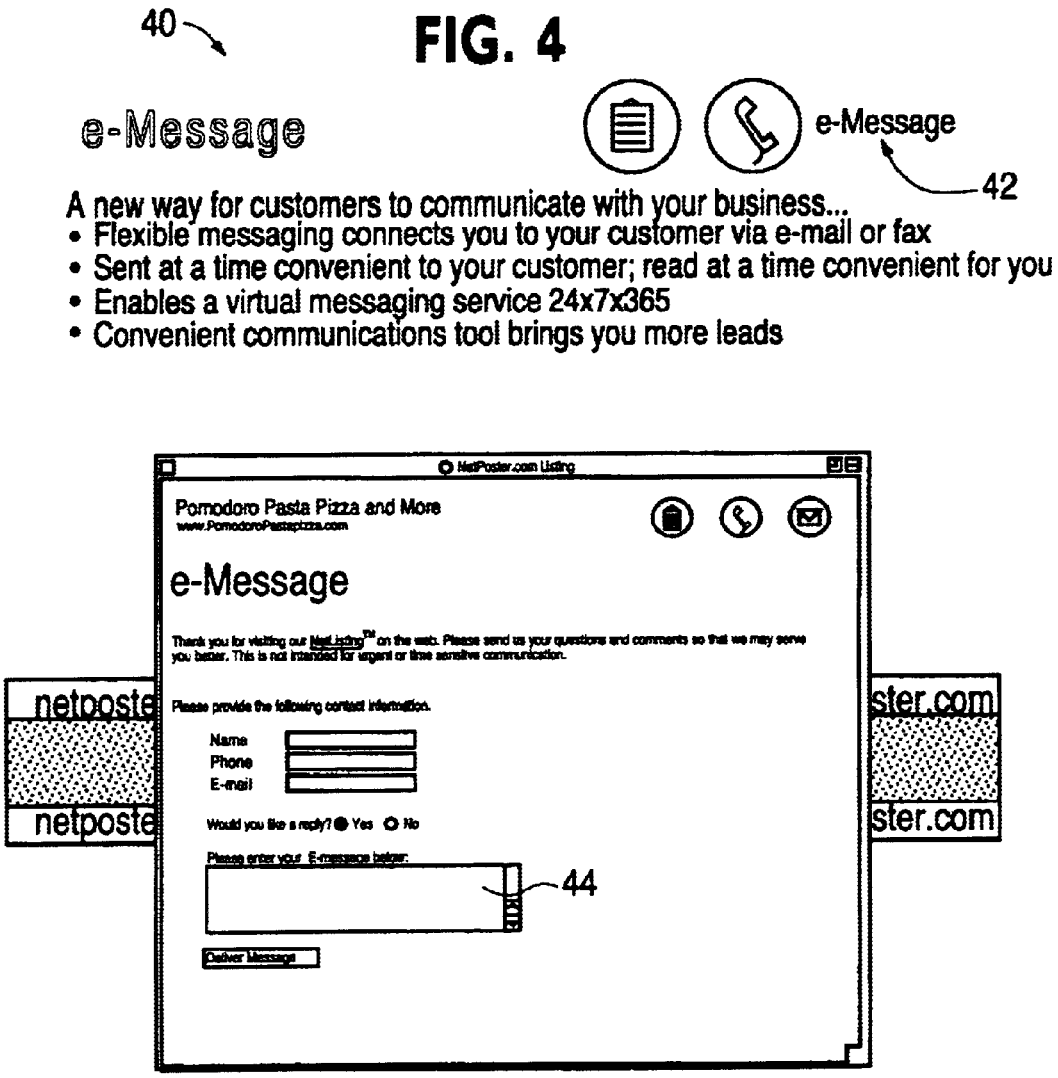
FIG. 4 is a screenshot of an e-Message page.

Shown in FIG. 2 is the infosheet. The infosheet 20 informs the customer about a business of interest to them. A simple to complex graphic may be displayed that is custom designed to the business. Shown are four separate business, 22, 24, 26, and 28.

Shown in FIG. 3 is the listing of a business. The listing 30 is comprised of approximately 24 specific parameters 32, applicable to most businesses. By employing these parameters, a searchable directory is formed that can be searched quickly and accurately. The parameters are in the table below.

| | |
|---|---|
| Company Name | Business Pk/Shopping Center |
| Trade Name | Primary Phone Number |
| Business Type | Secondary Phone Number |
| SIC | Fax |
| Contact Name | E-Mail |
| Address | Web Site |
| City | Payment Options |
| County | Certifications and Licenses |
| State | Year Established |
| Zip Code | Name Brand Sold or Serviced |
| Keywords | Hours of Operation |
| Within Boundary of Municipality | Areas Served |

The search function is based on the entry of the above parameters or multiple parameters to yield a query result.

The third element of the Internet brochure is the e-message 40. By clicking on the e-message button 42 a message 44 can be sent directly to business via e-mail or to the business's facsimile machine.

Other options such as the use of e-coupons can be presented as part of the Internet brochure.

Figure 5:
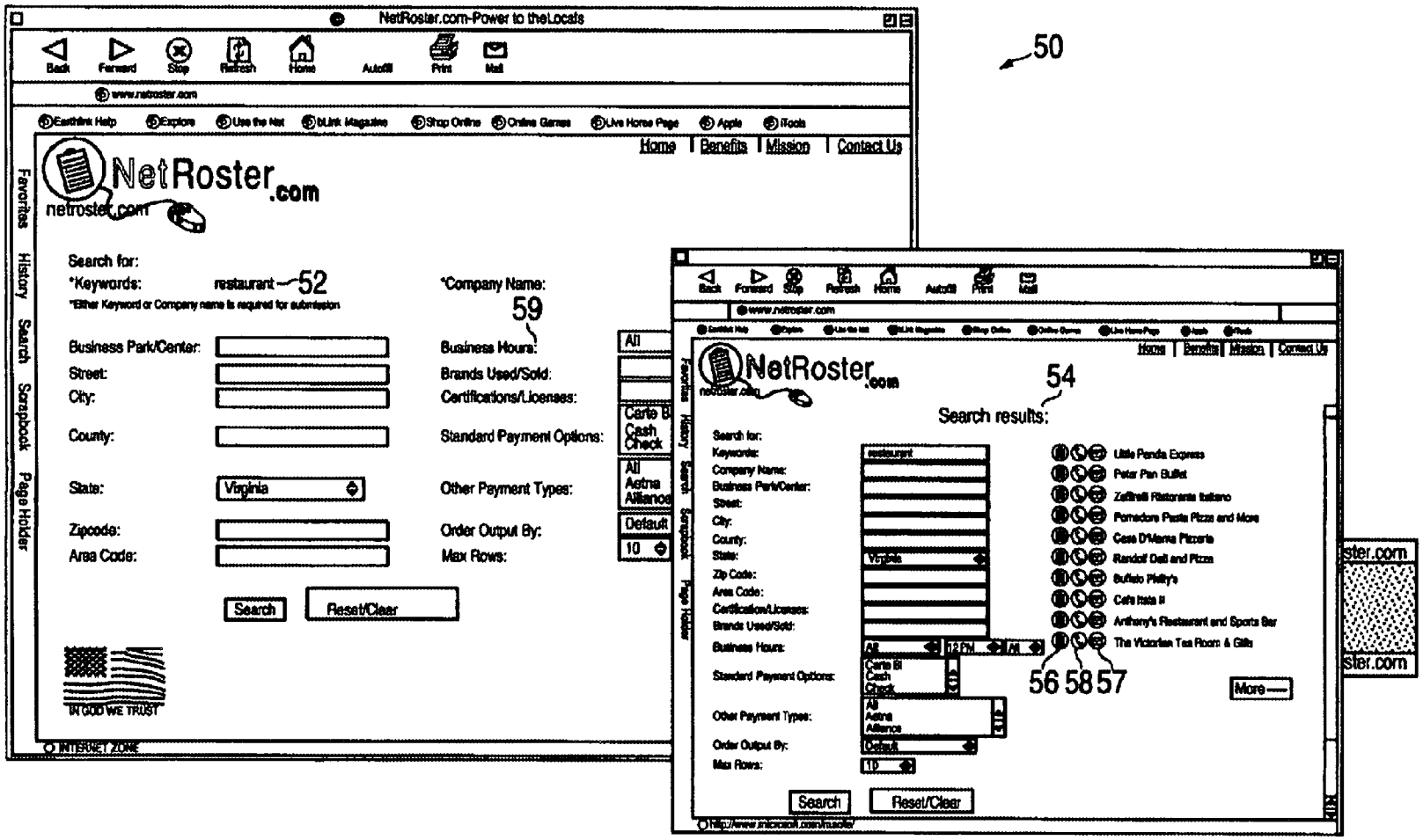
FIG. 5 is a screenshot of a NetRoster search request.

A typical search 50 is shown in FIG. 5 wherein a keyword "restaurant" shown as element 52 has been typed. The results are presented as a listing of restaurants meeting the search criteria 54. Adjacent to each "hit" is a click button to bring up an infosheet 56, a listing 58, or to contact the business establishment 57. One of the search criteria "business hours of operation" is shown as 59.

A unique feature of the present invention is the ability to utilize human factors for the translation of the business hours of operation. The Business Hours of operation 60 are presented to the database as shown in FIG. 6 where a daily open and close time is given. In a search result 70, the Hours of Operation 72 are shown on the right side of FIG. 7 where open and close times are listed for each day of the week. A re-open and re-close time 74 is also given for the days where the business remains open past midnight.

This invention clarifies the human time factoring in the Hours of Operation. If Monday's hours of operation are from 10:00 AM until 2:00 AM Tuesday, then Tuesday's early morning hours should be considered an extension of Monday's business hours. Human time perception can be confusing when operational day and real time do not coincide.

For example two hours past midnight on Friday night is equivalent to 2:00 AM Saturday, but perceived by many people as still Friday night. The present invention discloses a novel method for handling this problem.

There is a function applicable to the translation of time based on a person's type, history, age, and habits. A translation process can be used for calculating the time displayed to human interpretation. This can be done by assuming a unitless translation table. Assume T=Monday 2:00 AM. This can be translated into a unitless number N such that N is in ½ hour interval. Then Monday 2:00 AM=0, 2:30 AM=1, 3:00 AM=2, 3:30=3, and 4:00 AM=4 etc. Then Tuesday 2:00 AM=48 and Wednesday 2:00 AM=96. For translation purposes if Tuesday 1:30 AM was an input, then N=47. This can be compared to known values. Monday hours of operation from 10:00 AM to 2:00 AM will now be N=16 to N=48. If an input value is greater than N initial and less than N final, a true value is established and the time is included in the search criteria/results.

The unitless time interval can be chosen to represent any unit of time such as quarter hour intervals, or minute intervals. The span over which time tracking takes place can be weekly, monthly or yearly. Since many events repeat themselves over a yearly cycle, such as holidays, vacations or special promotions, a year span would be desirable. A PC could easily compute in minute increments over a year or more.

Figure 8:
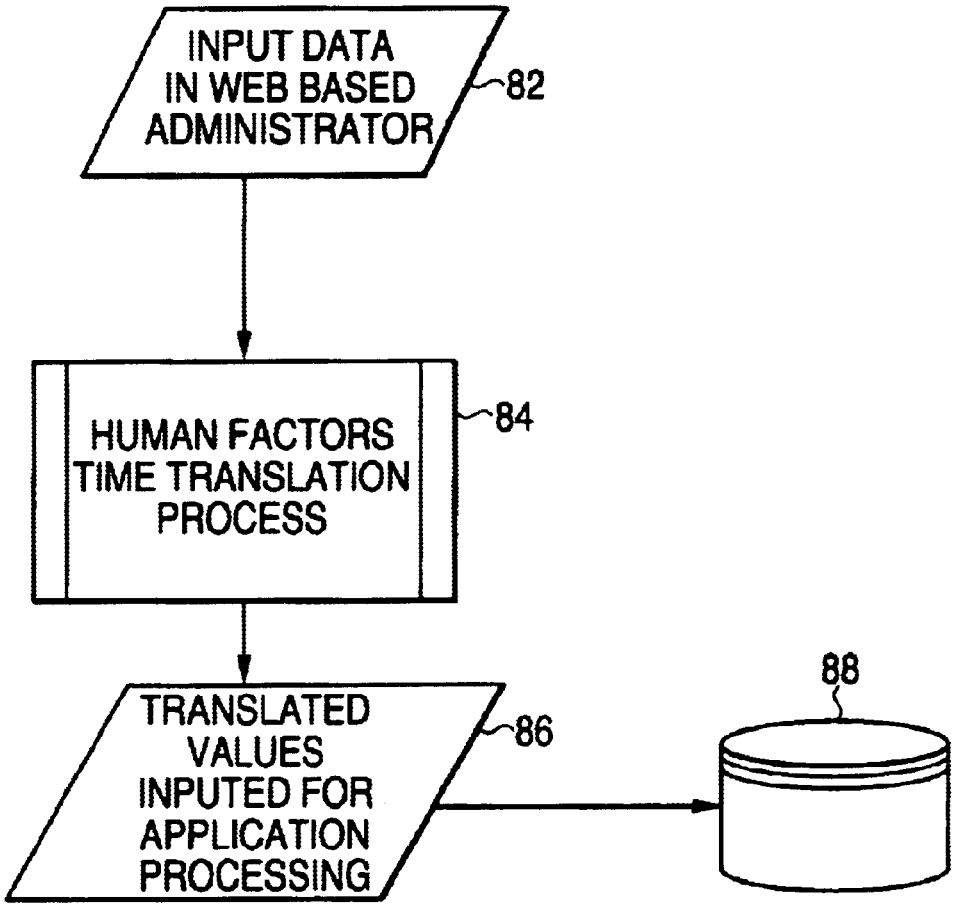
FIG. 8 is a flow diagram of translating time according to human factors.

Shown in FIG. 8, the information, including hours of operation, is input into a database, step 82. A human factors time translation process is performed, step 84. The translated values are input into the database for application processing, step 86. The database is represented by element 88.

Figure 9:
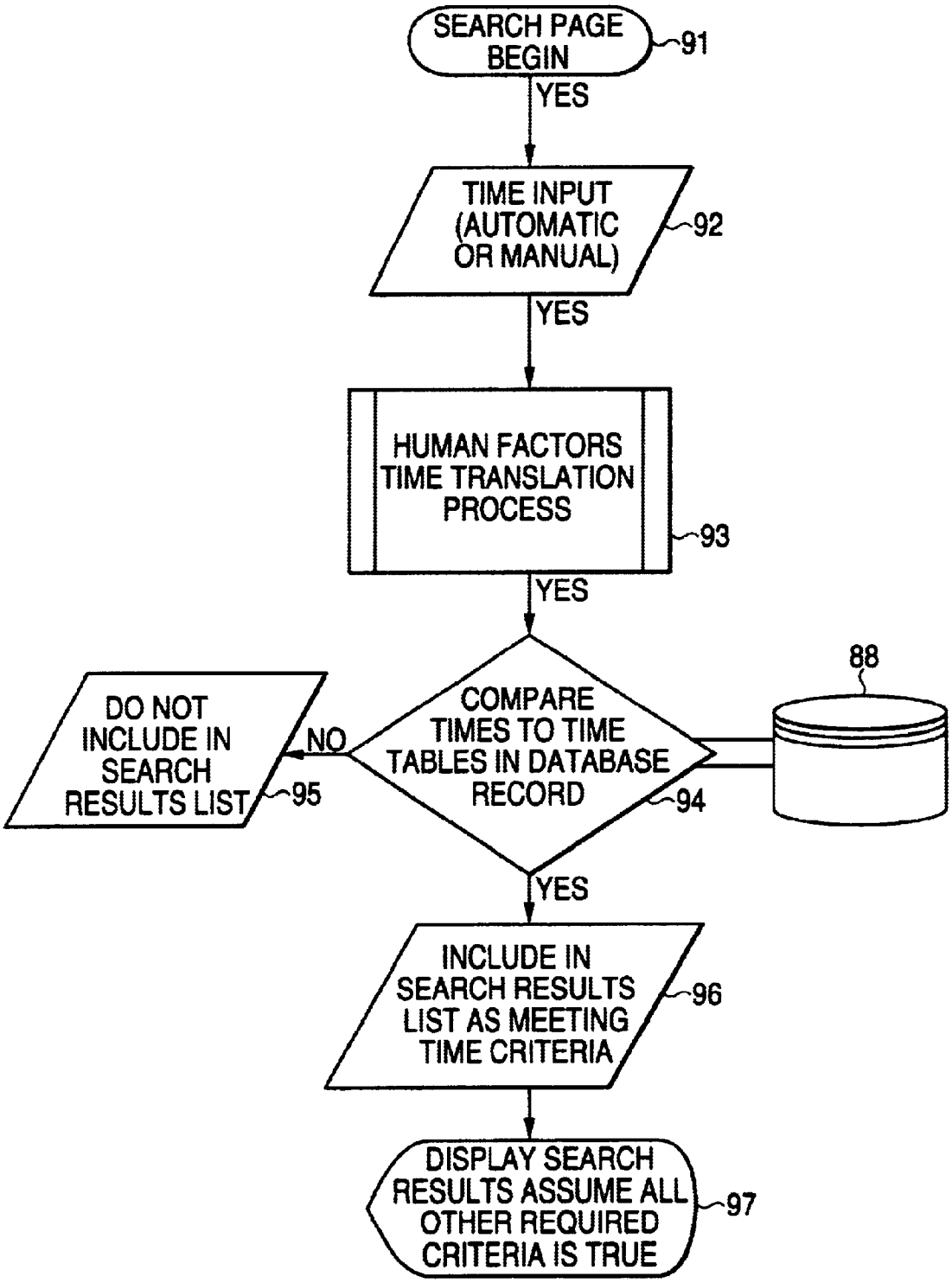
FIG. 9 is a flow diagram for human factor time translation searching.

While searching using the business hours of operation, the time search criteria are processed through the human factor time translation process. A comparison is made to time tables in the database record. If the comparison matches, the search results are displayed as meeting the time criteria. The software program flow for the search function is shown in FIG. 9. A search begins in step 91. The time of interest in input into the request, step 92. This can be either automatically done or entered manually. A human factors time translations is processed in step 93. The search request is processed in database 88 using the translated time in step 94. The results of any search are compared to human factors translated time by a comparator in step 95. If the results met the time translated criteria shown in step 96, then the search results are displayed in step 97.

Figure 10:
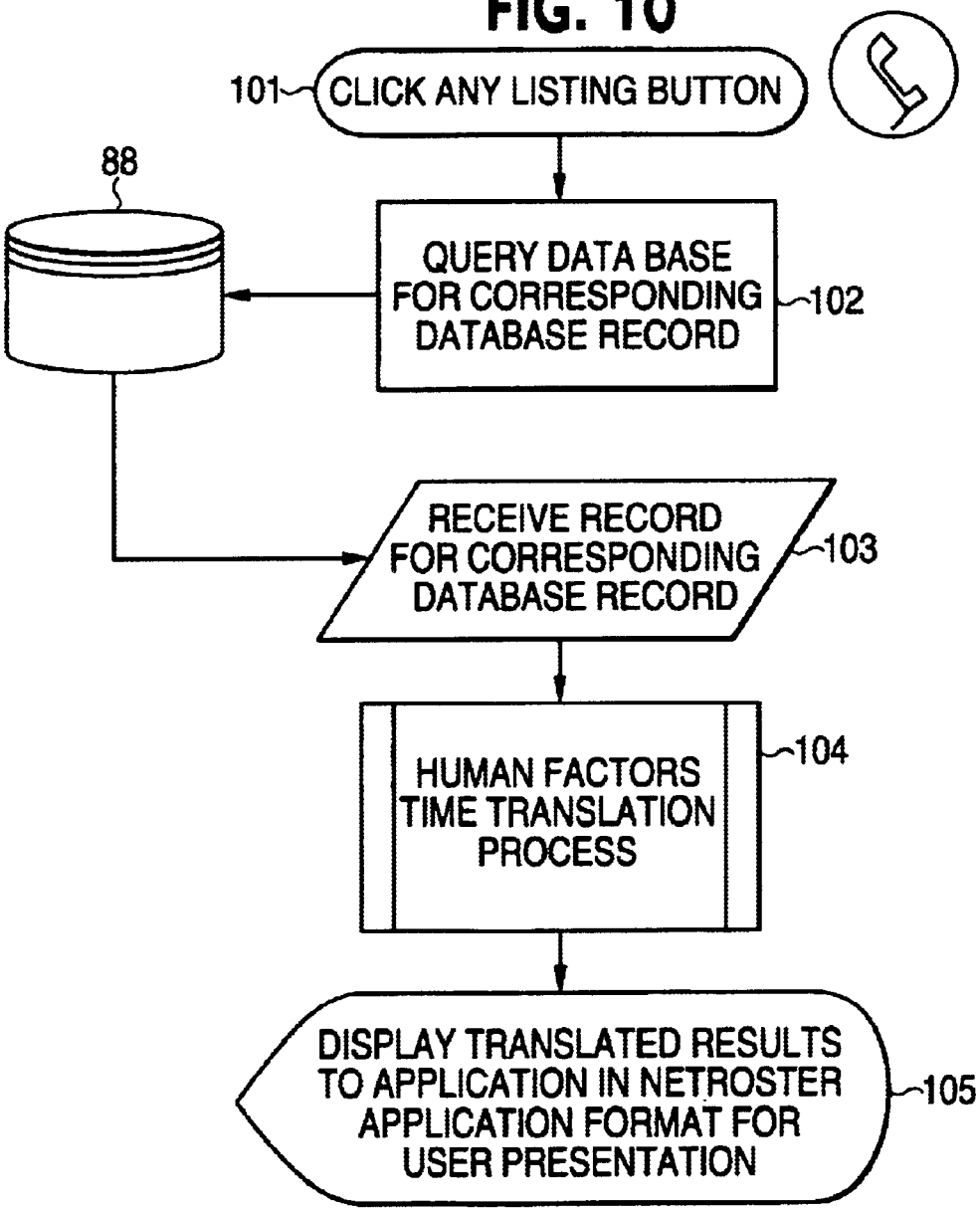
FIG. 10 is a flow diagram for human factor time translation display.

The display for the listing function also works using the human factor time translation function. As shown in FIG. 10, any query may be started in step 101. The query is presented to the database record step 102. The results from database 88 are received as record from the corresponding database in step 103. A human factor time translation is performed on the results in step 104. The results are displayed to the user in the listing format, step 105.

Outside variables can be used to condition the time translation table. That is if X occurs, than modify the table by Y. This conditional modification can be automatic or manually instituted. An example would be a business rule such as during the Christmas Holidays the business hours of operation are increased. Another example would be "closed" or reduced hours of operations during a schedule vacation such as the first two weeks in August. Again this could be manually or automatically input into the human factors time translation table.

While the invention has been described for use as a search function to consumers over the Internet, it is to be understood that the invention may be used in many other settings without limitation such as time clocks, staffing hours, commission rates, parking rates, variable pricing etc. Changes may be made within the purview of the appended claims without departing from the true scope and sprint of the invention in its broader aspects.

What is claimed is:

1. A system for providing time translation to a requester of information incorporating human factors comprising:

means for inputting a request for information into a system;

means for extracting time information contained in the request for information;

means for translating the time according to human factors;

means for comparing translated times to time in timetable database records;

means for determining to whether to include search results as meeting time criteria; and means for displaying search results assuming all other required criteria is present.

2. The system according to claim 1 wherein the human factors are determined manually based on attributes of the requestor.

3. The system according to claim 1 wherein the human factors are automatically gathered based on attributes of use of the system by requester.

4. The system of claim 1 wherein the timetable database is modified based upon conditional events.

5. A method of providing time translation to a requestor of information incorporating human factors comprising the steps of:

inputting a request for information into a system;

extracting time information contained in the request for information;

translating the time according to human factors;

comparing translated times to time in timetable database records;

determining to whether to include search results as meeting time criteria; and displaying search results assuming all other required criteria is present.

6. The method of claim 5 wherein the step of translating is performed manually based on attributes of the requestor.

7. The method of claim 5 wherein the step of translating is performed automatically based on attributes of the use of the method by the requester.

8. The method of claim 5 wherein the time translation timetable is conditioned upon the occurrence of specified events according to business rules.

9. A computer program in a computer readable medium, said medium comprising instructions to:

input a request for information into a system;

extract time information contained in the request for information;

translate the time according to human factors;

compare translated times to time in timetable database records;

determine to whether to include search results as meeting time criteria; and display search results assuming all other required criteria is present.

10. The computer program according to claim 9 wherein the human factors are determined manually based on attributes of a computer user.

11. The computer program according to claim 9 wherein the human factors are determined automatically based on the computer user.

12. The computer program according to claim 9 wherein the instructions are modified according to conditional events determined by the computer user.

13. A method of displaying time translated for human factors to a requestor of information comprising the steps of:

querying a data base for corresponding database records, the query having at least a component of time;

receiving records from the corresponding database in response to the query;

translating the time component according to human factors to meet criteria determined based on the requester;

displaying the translated time to the requester.

14. The method according to claim 13 wherein the human factors are determined manually based on the attributes of the requestor.

15. The method according to claim 13 wherein the human factors are determined automatically based on the attributes of the requestor.

* * * * *